US012404742B1

(12) United States Patent
Rejepov

(10) Patent No.: US 12,404,742 B1
(45) Date of Patent: Sep. 2, 2025

(54) DISPLACEMENT OPENING CONE FOR CEMENTING OPERATIONS

(71) Applicant: SAUDI ARABIAN OIL COMPANY, Dhahran (SA)

(72) Inventor: Dautmammet Rejepov, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/672,662

(22) Filed: May 23, 2024

(51) Int. Cl.
*E21B 33/16* (2006.01)

(52) U.S. Cl.
CPC ..... *E21B 33/16* (2013.01)

(58) Field of Classification Search
CPC ..... E21B 33/16
See application file for complete search history.

(56) References Cited

U.S. PATENT DOCUMENTS 3,789,926 A 2/1974 Henley et al.
8,066,069 B2 11/2011 Giroux et al.
8,800,655 B1 8/2014 Bailey
2022/0178224 A1 * 6/2022 Egbe ..... E21B 33/146

FOREIGN PATENT DOCUMENTS

SU 1239273 A1 * 6/1983

* cited by examiner

*Primary Examiner* — Dany E Akakpo
(74) *Attorney, Agent, or Firm* — Osha Bergman Watanabe & Burton LLP

(57) ABSTRACT

An opening cone for a mechanical stage collar is used during a cementing operation in a wellbore. The mechanical stage collar includes ports activated by the opening cone. The opening cone includes a cylindrical midsection and a conical end section defining a hollow path through the opening cone and a ball suspended in a cage in the cylindrical midsection between a first profile with a first set of ribs and a second profile with a second set of ribs. The second profile is disposed downhole of the first profile and the second set of ribs is pressure rated to rupture at a predetermined pressure and release the ball into the conical end section. The ball is configured to plug the hollow path of the opening cone when released into the conical end section to stop flow through the hollow path.

20 Claims, 7 Drawing Sheets

DISPLACEMENT OPENING CONE FOR CEMENTING OPERATIONS

BACKGROUND

In the petroleum industry, wells are drilled into the surface of the Earth to access and produce hydrocarbons. The process of building a well is often split into two parts: drilling and completion. Drilling a well may include using a drilling rig to drill a hole into the ground, trip in at least one string of casing, and cement the casing string in place. The casing string is used to define the structure of the well, provide support for the wellbore walls, and prevent unwanted fluid from being produced. The casing string is cemented in place to prevent formation fluids from exiting the formation and to provide further structure for the well.

After a casing string has been placed in the well, the annulus located between the casing string and the wellbore wall must be cemented completely (i.e., to surface) or partially. Cementing is done by pumping cement from the surface, through the inside of the casing string, and up the outside of the casing string (the annulus) to the required height. In some cases, a mechanical stage collar is installed in the casing string to perform the cementing operations. A slurry of cement is pumped through the casing string and is followed by another type of fluid and/or a plug to push or displace the remainder of the cement out of the inside of the casing and into the annulus. Oftentimes, especially in deviated wells, a large amount of cement is left under-displaced inside of the casing string. The under-displaced cement is left to harden and requires a dedicated cleanout BHA to drill out the hardened under-displaced cement before the next section of the well is drilled.

Accordingly, there exists a need for a displacement opening cone used in the mechanical stage collar or tool that minimizes cement slurry under-displacement.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to an opening cone for a mechanical stage collar used during a cementing operation in a wellbore, wherein the mechanical stage collar comprises a plurality of ports activated by the opening cone, the opening cone comprising: a cylindrical midsection and a conical end section defining a hollow path through the opening cone, wherein the cylindrical midsection comprises a cage comprising a first profile having a first set of ribs and a second profile having a second set of ribs disposed downhole of the first profile; and a ball suspended in the cage between the first profile and the second profile, via the second set of ribs, wherein the second set of ribs is pressure rated to rupture at a predetermined pressure and release the ball into the conical end section, wherein the cage is configured to allow flow through the hollow path via the first set of ribs and the second set of ribs around the ball while the second set of ribs is not ruptured, and wherein the ball is configured to plug the hollow path of the opening cone when released into the conical end section.

In one aspect, embodiments disclosed herein relate to method for performing a cementing operation in a wellbore, comprising: lowering a tubular pipe including a mechanical stage collar in a deviated section of the tubular pipe into the wellbore; performing a first stage of cementing by pumping a cement slurry through a landing collar at a bottom end of the tubular pipe and into an annulus between the tubular pipe and the wellbore; displacing a bottom plug through the tubular pipe towards the landing collar; latching an opening cone in the mechanical stage collar after displacing the bottom plug, the opening cone comprises a cylindrical midsection and a conical end section defining a hollow path through the opening cone; restricting flow through the hollow path using a cage in the cylindrical midsection comprising a first profile having a first set of ribs and a second profile having a second set of ribs; suspending a ball in the cage between the first profile and the second profile; landing the bottom plug onto the landing collar and displacing the cement slurry by restricting flow through the hollow path; rupturing the second set of ribs at a predetermined pressure achieved after the bottom plug lands on the landing collar; and plugging the hollow path by releasing the ball into the conical end section after rupturing the second set of ribs.

In another aspect, embodiments disclosed herein relate to a system for performing a cementing operation in a wellbore, comprising: a landing collar disposed at a bottom end of a tubular pipe in the wellbore pumped by cement; a mechanical stage collar installed in a deviated section of the tubular pipe; an opening cone configured to latch to the mechanical stage collar to activate a plurality of ports in the mechanical stage collar, the opening cone comprising: a cylindrical midsection and a conical end section defining a hollow path through the opening cone, wherein the cylindrical midsection comprises a cage comprising a first profile having a first set of ribs and a second profile having a second set of ribs disposed downhole of the first profile, and a ball suspended in the cage between the first profile and the second profile, via the second set of ribs, wherein the second set of ribs is pressure rated to rupture at a predetermined pressure and release the ball into the conical end section, wherein the cage is configured to allow flow through the hollow path via the first set of ribs and the second set of ribs around the ball while the second set of ribs is not ruptured, and wherein the ball is configured to plug the hollow path of the opening cone when released into the conical end section.

Other aspects and advantages of the claimed subject matter will be apparent from the following description and the appended claims.

DETAILED DESCRIPTION

Figure 1:
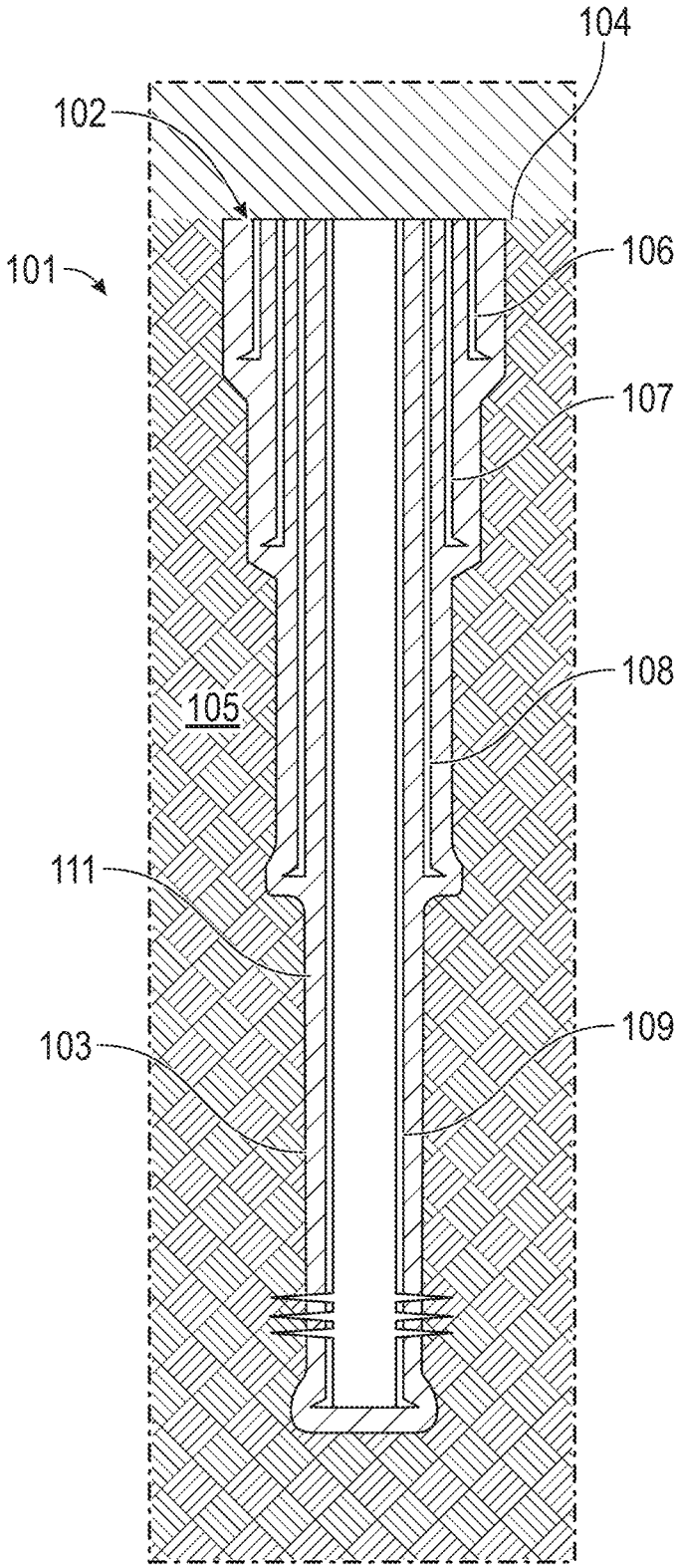
FIG. 1 shows a well system in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

Embodiments disclosed herein are described with terms designating in reference to a tubular, but any terms designating should not be deemed to limit the scope of the disclosure. For example, a tubular string is made up of numerous tubular pipes joined end-to-end, and each of the tubular pipes might be about twenty to forty feet in length. Further, the tubular pipes are hollow and thus provide a continuous channel of communication between the surface and the bottom of the wellbore, down through which a suitable fluid can be introduced to any region required within the well. It is to be further understood that the various embodiments described herein may be used with various types of tubulars, including but not limited to casing or liners, without departing from the scope of the present disclosure. A casing generally refers to a large-diameter pipe that is lowered into an openhole and cemented in place.

Further, embodiments disclosed herein are described with terms designating in reference to a cement operation, but any terms designating should not be deemed to limit the scope of the disclosure. Cement operations may be conducted to cement the tubular string within a wellbore. For example, a cement operation may refer to an operation of pumping a cement slurry downhole to cement the tubular string to a wellbore. As used herein, cement slurry may refer to a fluid made from a mixture of cement, cement additives and water. Additionally, cement operations may include various stages of cementing. For example, a first stage of cementing may refer to an initial pumping stage where the cement slurry is pumped down into a bore of the tubular string; next the cement slurry exits at a bottom of the tubular string and into an annulus between the tubular string and the wellbore; then the cement slurry flows upward on an outer surface of the tubular string to fill the annulus to a required depth; and lastly, the cement slurry is settled to cement the tubular string within the wellbore. A second stage of cementing may refer to a stage where the cement slurry is pumped down into the bore of the tubular string and into the annulus, via a stage cementing differential valve tool, without having to exit the bottom of the tubular string. While only a first and second stage of cementing are described, any number of stages of cementing may be used without departing the scope of the disclosure.

In general, embodiments of the disclosure describe an opening cone for a mechanical stage collar used during a cementing operation in a wellbore. More specifically, the opening cone may be used to displace cement slurry for cement job execution. Additionally, embodiments of the disclosure include systems and methods for performing the cementing operation in the wellbore using the opening cone. In some embodiments, the method includes installing the mechanical stage collar in a casing and a first stage cementing operation is performed. After the cement slurry is pumped into the casing, a bottom plug is displaced into the wellbore towards a landing collar to displace the cement slurry. The opening cone is then released and latched in the mechanical stage collar. The opening cone allows flow through the mechanical stage collar to help displace under-displaced cement left in the casing. Once the pressure inside the wellbore increases to a predetermined pressure from the plug bumping or reaching the landing collar, the opening cone becomes plugged and a second stage cementing operation may be performed.

Advantages of the embodiments disclosed herein include minimizing the need for engineered and pre-planned under-displacement cement slurry for cement job executions. Further benefits include positively impacting well construction cost and time.

A completed well (101), as illustrated in FIG. 1, includes a casing profile (102) within a wellbore (103) extending from a surface (104) into subterranean formations (105). In general, there may be many layers of subterranean formations (105) below the surface (104). The casing profile (102) includes multiple casing strings, such as a conductor casing (106), a surface casing (107), an intermediate casing (108), and a production casing (109). The conductor casing (106) may be a large-diameter casing that protects shallow formations from contamination by drilling fluid and helps prevent washouts involving unconsolidated topsoils and sediments. The surface casing (107), the second string, has a smaller diameter than the conductor casing (106), maintains borehole integrity and prevents contamination of shallow groundwater by hydrocarbons, subterranean brines and drilling fluids. The intermediate casing (108), the third string, has a smaller diameter than the surface casing (107), isolates hydrocarbon-bearing, abnormally pressured, fractured and lost circulation zones, providing well control as engineers drill deeper. Multiple strings of the intermediate casing (108) may be required to reach the target producing zone. The production casing (109), or liner, is the last and smallest tubular element in the completed well (101). The production casing (109) isolates the zones above and within the production zone and withstands all of the anticipated loads throughout the well's life. Additionally, the production casing (109) may be perforated 10 to allow hydrocarbons to flow into the production casing (109).

Furthermore, each casing string (106-109) undergoes a cement operation. Typically, a well section is drilled; then a casing string (e.g., the conductor casing (106), the surface casing (107), the intermediate casing (108), or the production casing (109)) is lowered into the wellbore (103) and then cemented. In a cement operation, a slurry (111) of cement, cement additives and water is pumped into the wellbore (103) down through the casing string (106-109) and into an annulus around the casing string (106-109) or in the open hole below the casing string (106-109). In some cases, the cement slurry (111) is introduced into the annulus without pumping the cement slurry (111) around the bottom end of the casing string (106-109). To achieve this, a stage cementing tool, herein after also referred to as "mechanical stage collars" or "differential valve tools," installed at various depths along the casing string (106-109), may be used to introduce the cement slurry (111) directly into the annulus along a length of the casing string (106-109). Cement slurry (111) supports and protects well casings and helps achieve zonal isolation while protecting the surrounding environment. However, conventional stage cementing tools may have poor cement displacement where there is a large amount of cement slurry left in the annulus, in other words "under-displacement cement slurry."

Figure 2:
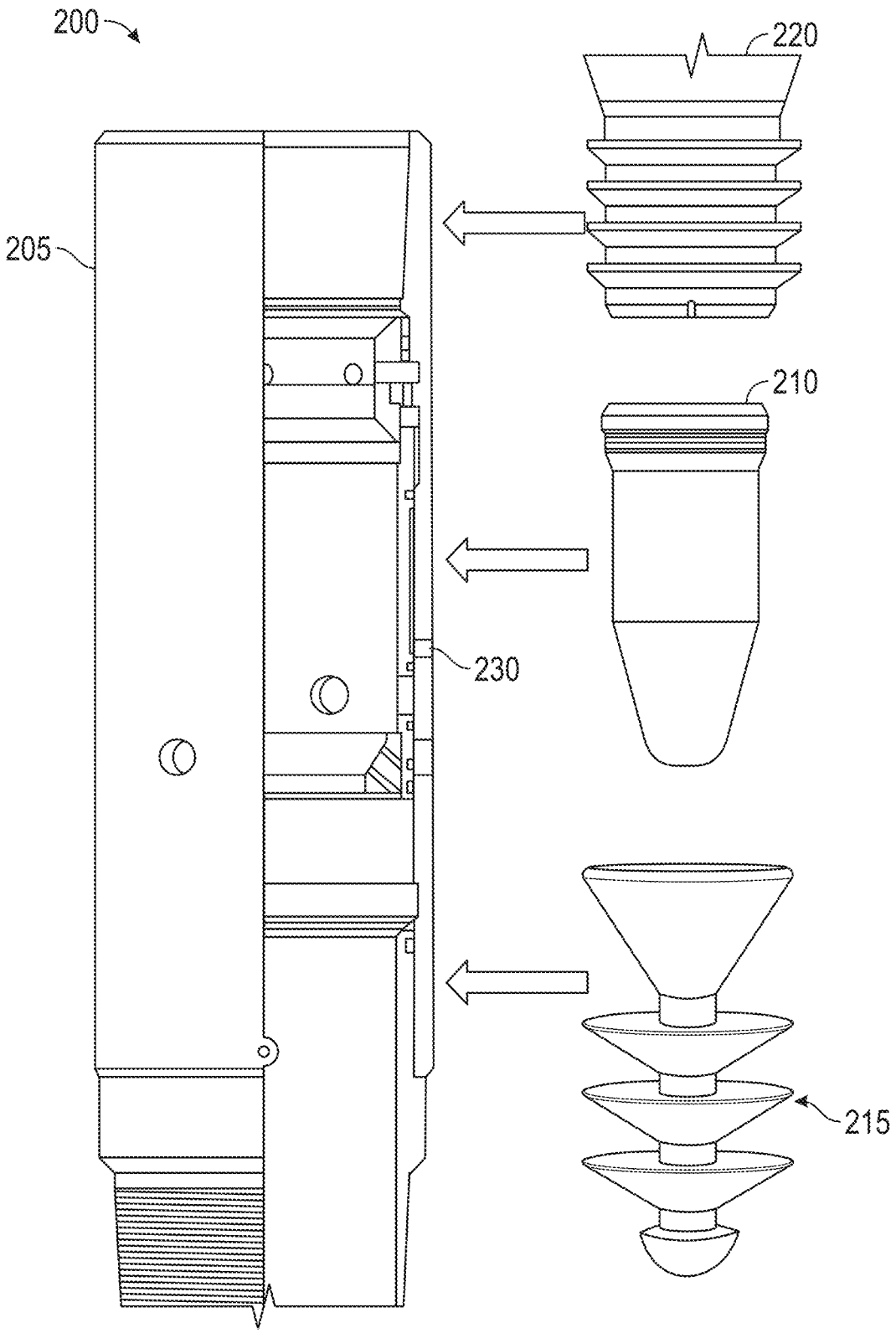
FIG. 2 shows a conventional casing cementing mechanically operated port system in accordance with one or more embodiments.

FIG. 2 shows a conventional casing cementing mechanically operated port system (200) in accordance with one or more embodiments. Specifically, FIG. 2 illustrates example components commonly used in the conventional system. The components may include a mechanical ported stage collar (205), a conventional opening cone (210), a bottom displacement plug (215), and a shut off plug (220). The mechanical ported stage collar (205) includes a plurality of ports (230). The ports (230) may be designed to fluidly connect an inner bore of the mechanical ported stage collar (205) and the wellbore (103). In wells with vertical or near vertical inclinations, stage cementing may be accomplished using mechanical stage collars with free falling gravity assisted cones because no cement slurry under-displacement is expected. Free falling gravity assisted cones may be used in wells with low inclination, such as 25 to 35 degrees. For example, in such cases, the bottom displacement plug (215) is displaced with mud and displaces cement slurry until the bottom displacement plug (215) bumps into a stage collar or landing collar. This process may also be referred to as plug bumping. The bottom displacement plug (215) may have an outer diameter less than an inner diameter of the mechanical ported stage collar (205). Once the bottom displacement plug (215) bumps into the landing collar, a free-falling gravity assisted opening cone is released into the mechanical ported stage collar (205). In one or more embodiments, a certain amount of time is allowed for the opening cone to latch into the mechanical ported stage collar (205) and open ports in the mechanical ported stage collar (205) for second stage cementing.

However, in cases where a mechanical stage collar is placed above a certain inclination in a well, a displacement type opening cone is required.

Figure 3:
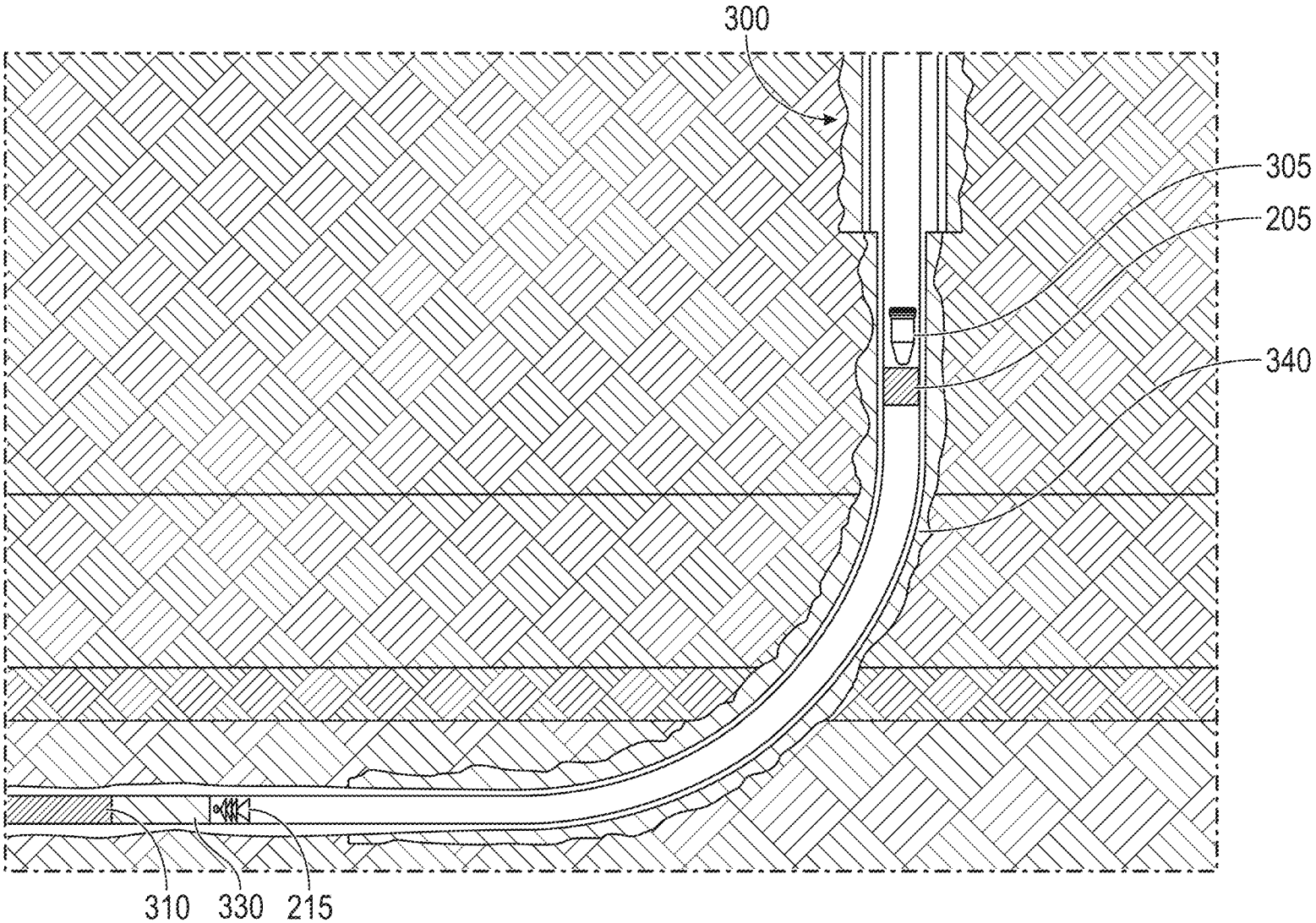
FIG. 3 shows a well system in accordance with one or more embodiments.

In FIG. 3, a well system is shown in accordance with one or more embodiments. In FIG. 3, a deviated well (300) includes a mechanical ported stage collar (205) installed above an inclined section of the deviated well (300). As stated previously, a displacement type opening cone (305) may be used in such cases. A displacement type opening cone (305) requires mud pumping or displacing behind the displacement type opening cone (305). This allows the bottom displacement plug (215) to travel/traverse through the mechanical ported stage collar (205) and land in a float shoe or landing collar (310) to end a first stage of cementing. Thus, simultaneous displacement of the bottom displacement plug (215) and the displacement type opening cone (305) is required. As illustrated in FIG. 3, to prevent premature plug bumping before the displacement type opening cone (305) latches to the mechanical ported stage collar (205), a specified amount of under-displaced cement slurry (330) for a first stage cementing job is pre-planned. The specified amount may be dependent on casing size. For example, a common amount of under-displaced cement slurry (330) left in the casing (340) may range from 15 to 30 barrels (bbls).

The under-displaced cement slurry (330) may then turn into hardened cement on top or uphole from the shoe track with the landing collar (310) inside the casing (340). This hardened under-displaced cement slurry (330) must then be cleaned or drilled out with a dedicated clean out bottom hole assembly before completion or second stage cementing.

Figure 4:
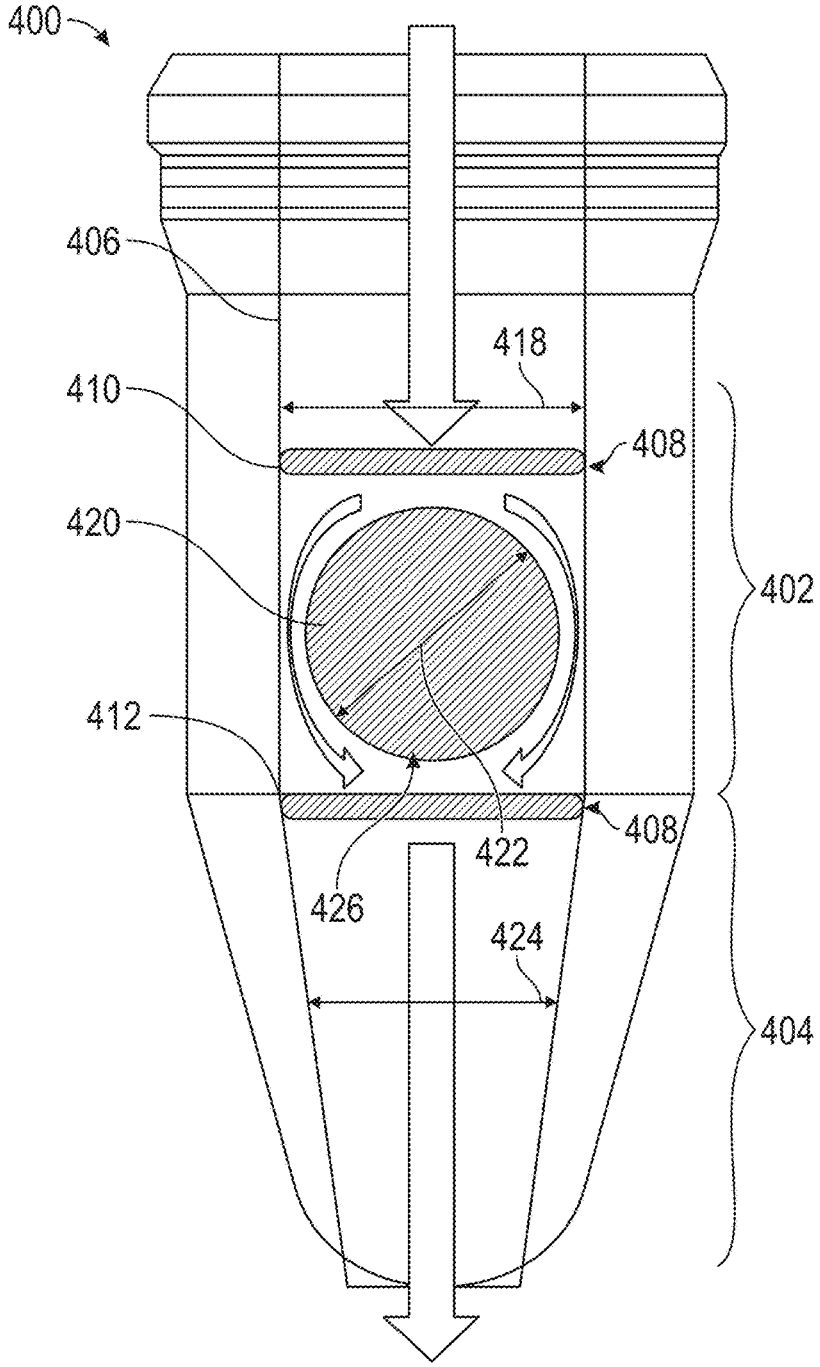
FIG. 4 shows an opening cone in accordance with one or more embodiments.

FIG. 4 shows an opening cone (400) in accordance with one or more embodiments. Specifically, FIG. 4 illustrates an opening cone (400) that may be used in deviated wells with a mechanical stage collar (e.g., mechanical ported stage collar (205)) installed. The opening cone (400) in FIG. 4 is shown before deployment. The opening cone (400) includes a cylindrical midsection (402) and a conical end section (404) which define a hollow path (406) through the opening cone (400). The hollow path (406) may be the internal profile of the opening cone (400). The hollow path (406) may be of conical shape. A cage (408) is implemented into the cylindrical midsection (402) of the opening cone (400). The cage (408) includes an upper or first profile (410) and a lower or second profile (412). The second profile (412) is disposed downhole from the first profile (410). The first profile (410) and the second profile (412) may have a round shape to fit inside the hollow path (406). The first profile (410) and the second profile (412) have diameters X and Y (414, 416), shown in FIGS. 5 and 6, equivalent to an inner diameter A (418) of the cylindrical midsection (402). The cage (408) includes a ball (420) suspended between the first profile (410) and the second profile (412). The ball (420) is suspended inside the cage (408) by a second set of ribs (602), shown in FIG. 6. The ball (420) has an outer diameter (422) equivalent to an inner diameter (424) of the conical end section (404). The cage (408) may include a ball seat (426). The ball seat (426) may be any mechanism known in the art to hold the ball (420) in place.

Figure 5:
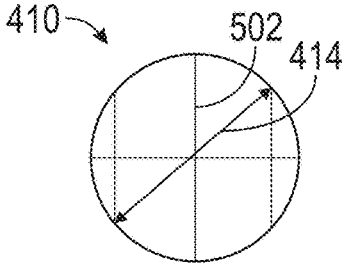
FIGS. 5 and 6 show cross sectional views of the first and second profiles of the opening cone before deployment in accordance with one or more embodiments.
Figure 6:
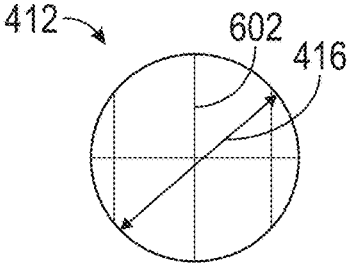

FIGS. 5 and 6 show cross sectional views of the first profile (410) and the second profile (412) before deployment in accordance with one or more embodiments. FIG. 5 shows the first profile (410). The first profile (410) includes a first set of ribs (502). FIG. 6 shows the second profile (412). The second profile (412) includes a second set of ribs (602). The profiles (410, 412) and the ribs (502, 602) may be made up of any material known in the art capable of holding the ball (420) in a cage-like configuration inside the opening cone (400). The second set of ribs (602) are pressure rated to rupture at a predetermined pressure. The first and second set of ribs (502, 602) of the cage (408) are designed to allow flow through the hollow path (406). Flow may include fluid flow, such as mud or water. The first set of ribs (502) and the second set of ribs (602) may be of a grid configuration or any kind of configuration which allows the ball (420) to stay suspended and flow. Configurations may include window-pane, honeycomb, etc.

Figure 7:
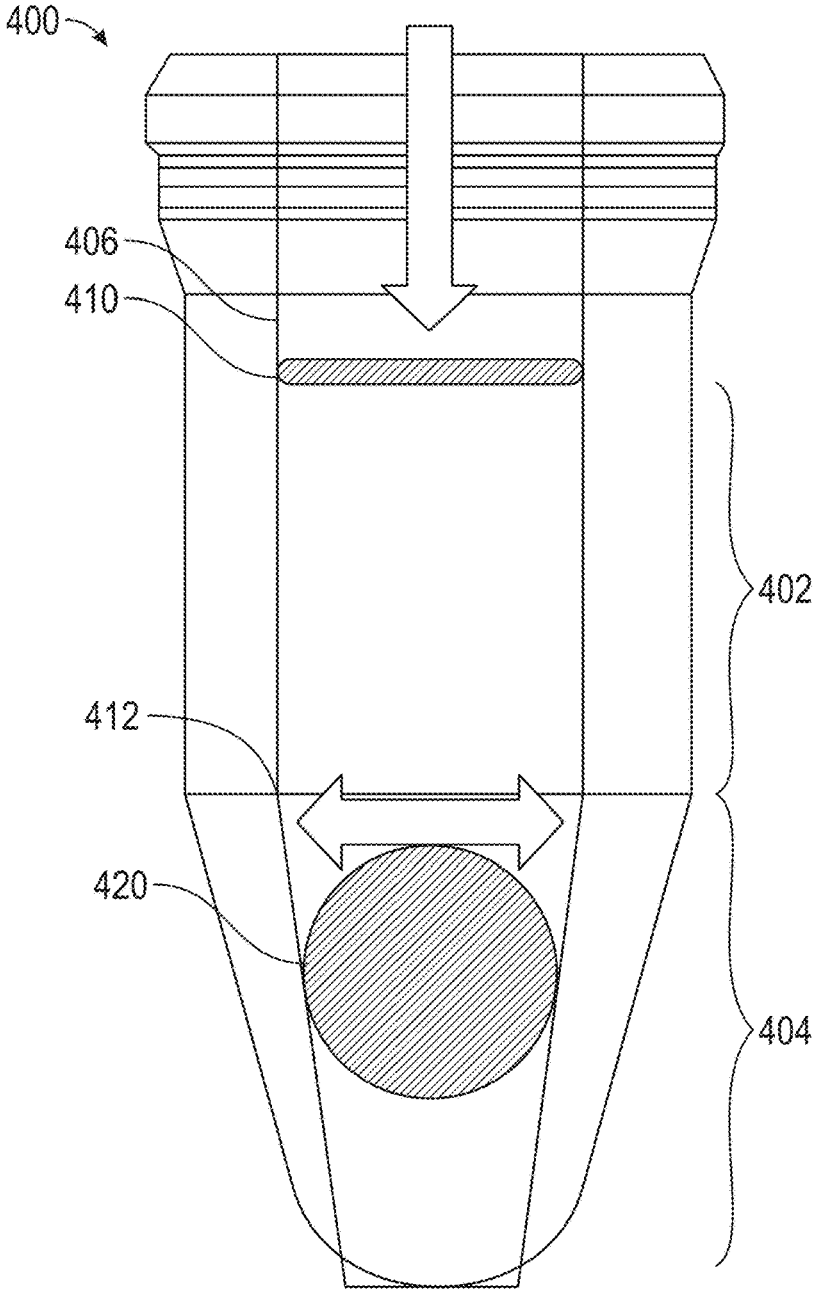
FIG. 7 shows the opening cone deployed in accordance with one or more embodiments.

FIG. 7 shows the opening cone (400) deployed in accordance with one or more embodiments. Once the second set of ribs (602) rupture at a specific pressure, the ball (420) is released into the conical end section (404). The ball (420) is shown in the conical end section (404) plugging the hollow path (406) of the opening cone (400).

Figure 8:
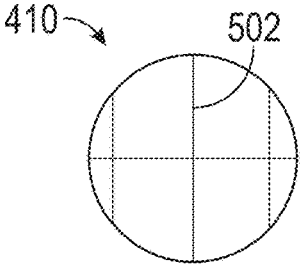
FIGS. 8 and 9 show cross sectional views of the first and second profiles of the opening cone after deployment in accordance with one or more embodiments.
Figure 9:
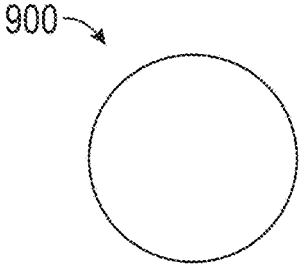

FIGS. 8 and 9 show cross sectional views of the first profile (410) and the second profile (412) after deployment of the opening cone (400) in accordance with one or more embodiments. FIG. 8 shows the first profile (410) with the first set of ribs (502) still intact, similar to FIG. 5 before deployment. FIG. 9 shows the second profile after deployment (900) when the second set of ribs (602) were ruptured. In some embodiments, there may be pieces of the second set of ribs (602) still part of the second profile after deployment (900).

Figure 10:
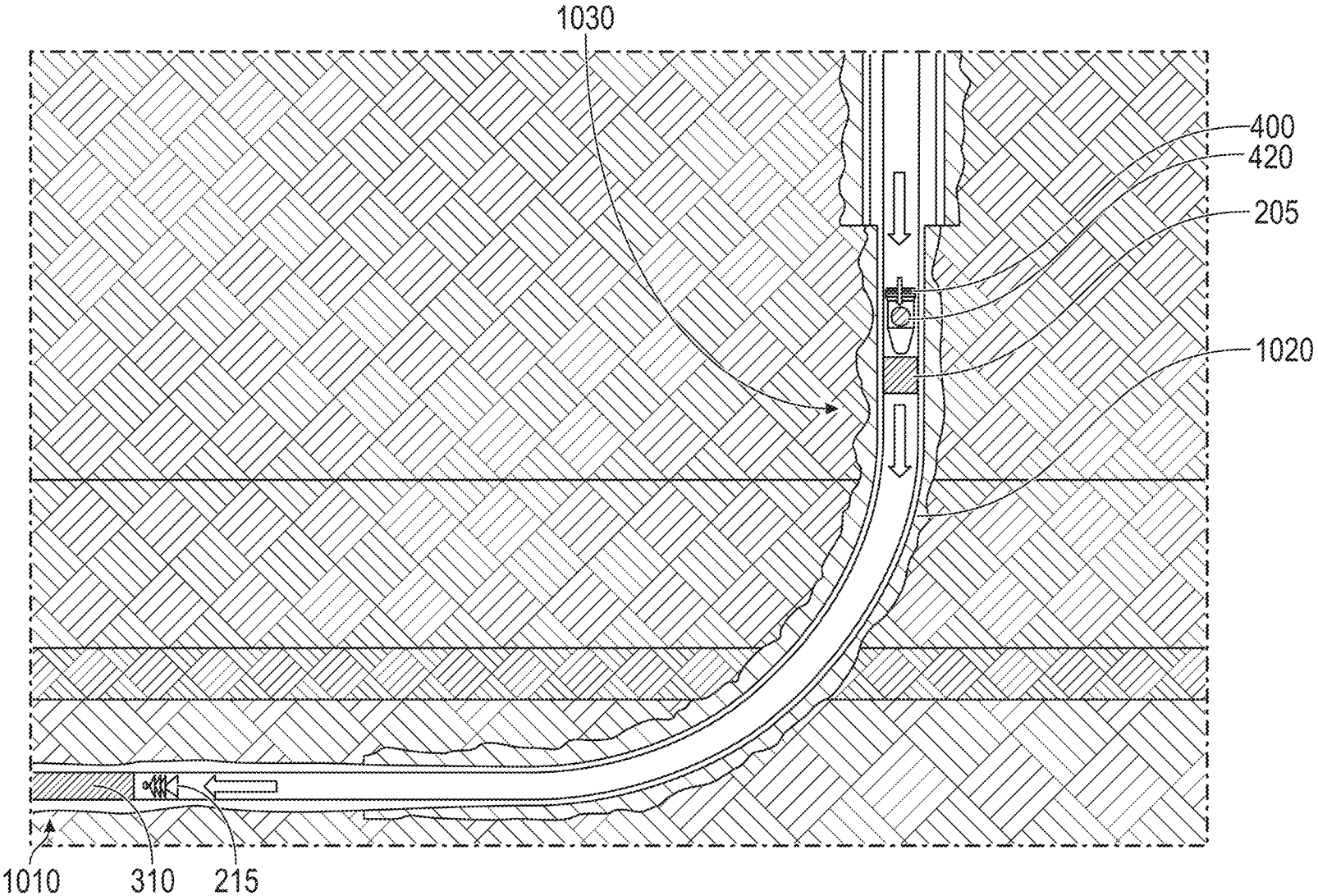
FIG. 10 shows a well system implemented with the opening cone used in conjunction with FIGS. 4-9 in accordance with one or more embodiments.

FIG. 10 shows a well system implemented with the opening cone (400) described in FIGS. 4-9 in accordance with one or more embodiments. Similar to the well system in FIG. 3, FIG. 10 shows a deviated well with a mechanical ported stage collar (205). The well system includes a landing collar (310) or stage collar disposed at a bottom end (1010) of a tubular pipe (1020) in a wellbore (103) pumped by cement (not shown) or undergoing a first stage cementing operation. The tubular pipe (1020) may be a casing or any other piping discussed in FIG. 1. The mechanical ported stage collar (205) is installed in a deviated section (1030) of the tubular pipe (1020). The opening cone (400) is illustrated as nearly latched to the mechanical stage collar (205). As described in previous embodiments, the opening cone (400) suspends the ball (420) inside the cage (408). The first and second set of ribs (502, 602) in the opening cone (400) allow flow through the hollow path (406) and around the ball (420) while intact before deployment.

FIG. 10 further illustrates the bottom displacement plug (215) traveling through the tubular pipe (1020) and down to the landing collar (310). As illustrated, there is no cement slurry in FIG. 10, because by allowing flow through the opening cone (400), the bottom displacement plug (215) is able to displace most or all cement that was pumped during a first stage cementing operation. The flow may be low or restricted due to the first and second set of ribs (502, 602) in the cage (408). However, it is still possible for the flow to displace the bottom displacement plug (215) to bump on the landing collar (310).

Figure 11:
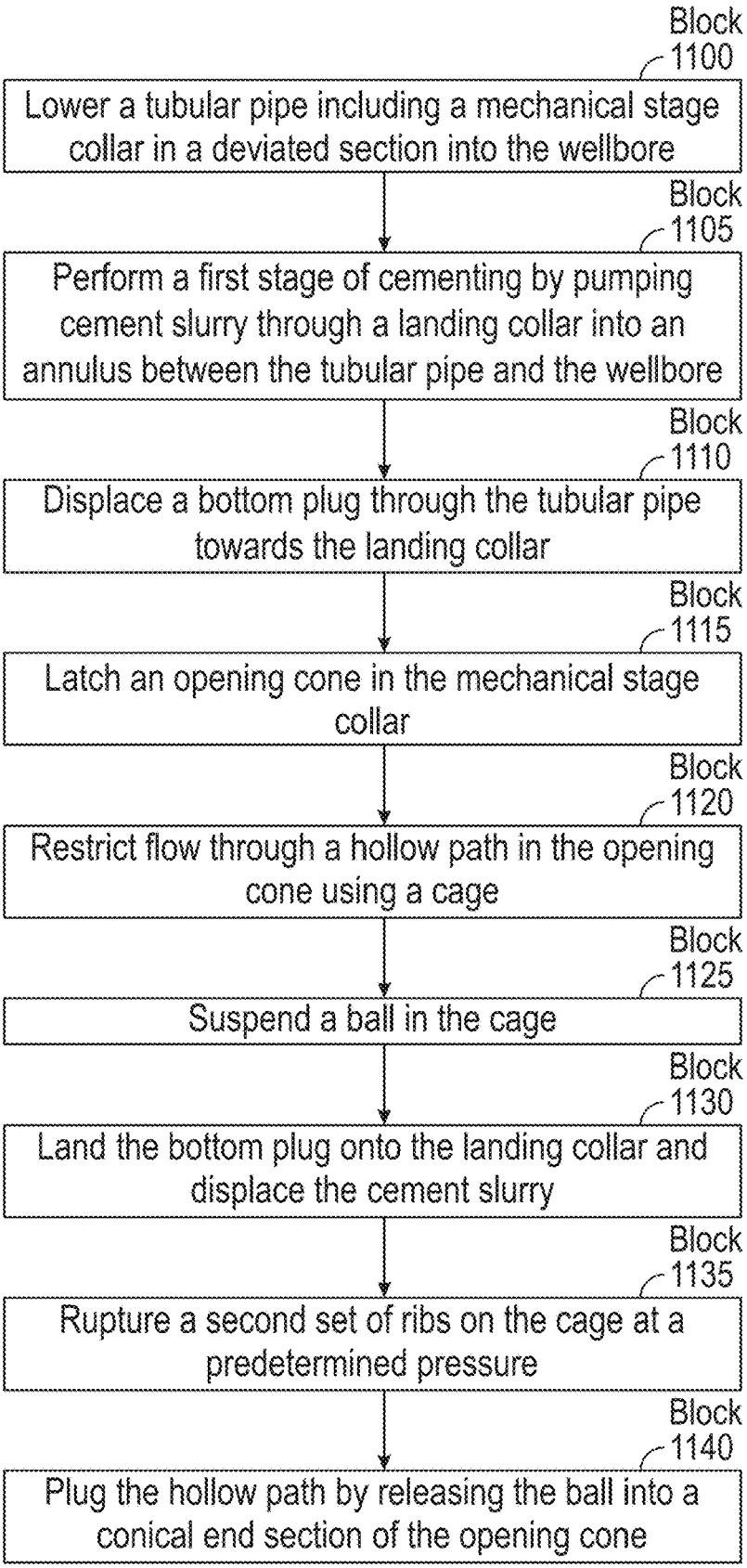
FIG. 11 shows a flowchart in accordance with one or more embodiments.

FIG. 11 shows a flowchart in accordance with one or more embodiments. Specifically, FIG. 11 shows the methodology for performing a cementing operation in a wellbore. One or more steps in FIG. 11 may be performed by one or more components (i.e., opening cone (400)) as described in FIGS. 1-10.

In Block 1100, a tubular pipe including a mechanical stage collar in a deviated section of the tubular pipe is lowered into the wellbore. In Block 1105, a first stage of cementing is performed by pumping cement slurry through a landing collar into an annulus between the tubular pipe and the wellbore. The landing collar is disposed at a bottom end of the tubular pipe. During the first stage of cementing, a preplanned under-displaced cement slurry volume may be executed.

In Block 1110, a bottom plug is displaced through the tubular pipe towards the landing collar. The landing collar may be part of a shoe track. The bottom plug may be displaced by pumping mud into the tubular pipe through the mechanical stage collar and opening cone. The bottom plug may travel through the tubular pipe separating the pumped mud and the pumped cement slurry. In Block 1115, an opening cone is latched in the mechanical stage collar. The opening cone includes a cylindrical midsection and a conical end section defining a hollow path through the opening cone.

In Block 1120, flow is restricted through the hollow path using a cage. The cage is disposed in the cylindrical midsection. The cage includes a first profile having a first set of ribs and a second profile having a second set of ribs. The first and second profile have a diameter equivalent to an inner diameter of the cylindrical midsection to fit and stay in place inside the opening cone. In Block 1125, a ball is suspended in the cage. The ball is suspended between the first profile and the second profile. The ball seat may be included in the cage to hold the ball in place for suspension. Although the flow may be restricted, there is enough flowrate through the cage and around the ball to continue displacing the bottom plug to bump the landing collar. In Block 1130, the bottom plug lands onto the landing collar and displaces the cement slurry. The preplanned under-displaced cement slurry that was pumped may be displaced fully by the bottom plug. Once the bottom plug is bumped and under-displaced cement slurry is minimized or eliminated, the tubular pipe undergoes a buildup of pressure. In Block 1135, the second set of ribs on the cage rupture at a predetermined pressure. The predetermined pressure is achieved when the bottom plug lands on the landing collar causing an increase of pressure in the wellbore and tubular pipe.

In Block 1140, the hollow path is plugged by releasing the ball into the conical section. Once the second set of ribs is ruptured, the ball is released into the conical end section. An outer diameter of the ball is equivalent to an inner diameter of the conical end section allowing the ball to plug the conical end section and not drop from the opening cone. Once the hollow path is plugged, a string of the tubular pipe uphole from the mechanical stage collar may be a closed system pressurizing the string. The pressure build up in the string uphole from the mechanical stage collar may activate ports in the mechanical stage collar. The ports when activated may be designed to hydraulically connect an inner bore of the mechanical stage collar and the wellbore. A second stage of cementing may then be performed through the activated ports and into the annulus between the casing and the wellbore.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. An opening cone for a mechanical stage collar used during a cementing operation in a wellbore, wherein the mechanical stage collar comprises a plurality of ports activated by the opening cone, the opening cone comprising:

a cylindrical midsection and a conical end section defining a hollow path through the opening cone, wherein the cylindrical midsection comprises a cage comprising a first profile having a first set of ribs and a second profile having a second set of ribs disposed downhole of the first profile; and a ball suspended in the cage between the first profile and the second profile, via the second set of ribs, wherein the second set of ribs is pressure rated to rupture at a predetermined pressure and release the ball into the conical end section, wherein the cage is configured to allow flow through the hollow path via the first set of ribs and the second set of ribs around the ball while the second set of ribs is not ruptured, and wherein the ball is configured to plug the hollow path of the opening cone when released into the conical end section.

2. The opening cone of claim 1, wherein the first profile and second profile comprise a diameter equivalent to an inner diameter of the cylindrical midsection.

3. The opening cone of claim 1, wherein an outer diameter of the ball is equivalent to an inner diameter of the conical end section.

4. The opening cone of claim 1, wherein the cage comprises a ball seat configured to hold the ball in place.

5. The opening cone of claim 1, wherein the first set of ribs and the second set of ribs comprise a grid configuration.

6. A method for performing a cementing operation in a wellbore, comprising:

lowering a tubular pipe including a mechanical stage collar in a deviated section of the tubular pipe into the wellbore;

performing a first stage of cementing by pumping a cement slurry through a landing collar at a bottom end of the tubular pipe and into an annulus between the tubular pipe and the wellbore;

displacing a bottom plug through the tubular pipe towards the landing collar;

latching an opening cone in the mechanical stage collar after displacing the bottom plug, the opening cone comprises a cylindrical midsection and a conical end section defining a hollow path through the opening cone;

restricting flow through the hollow path using a cage in the cylindrical midsection comprising a first profile having a first set of ribs and a second profile having a second set of ribs;

suspending a ball in the cage between the first profile and the second profile;

landing the bottom plug onto the landing collar and displacing the cement slurry by restricting flow through the hollow path;

rupturing the second set of ribs at a predetermined pressure achieved after the bottom plug lands on the landing collar; and plugging the hollow path by releasing the ball into the conical end section after rupturing the second set of ribs.

7. The method of claim 6, wherein plugging the hollow path comprises pressurizing a string of the tubular pipe uphole from the mechanical stage collar.

8. The method of claim 7, further comprising:

activating a plurality of ports in the mechanical stage collar by pressurizing the string uphole from the mechanical stage collar; and performing a second stage of cementing through the activated plurality of ports into the annulus.

9. The method of claim 6, wherein displacing the bottom plug comprises pumping mud into the tubular pipe through the mechanical stage collar and the opening cone.

10. The method of claim 9, wherein landing the bottom plug onto the landing collar comprises separating the pumped mud from the pumped cement slurry.

11. The method of claim 6, wherein suspending the ball in the cage comprises holding the ball in place via a ball seat.

12. The method of claim 6, wherein an outer diameter of the ball is equivalent to an inner diameter of the conical end section.

13. A system for performing a cementing operation in a wellbore, comprising:

a landing collar disposed at a bottom end of a tubular pipe in the wellbore pumped by cement;

a mechanical stage collar installed in a deviated section of the tubular pipe;

an opening cone configured to latch to the mechanical stage collar to activate a plurality of ports in the mechanical stage collar, the opening cone comprising:

a cylindrical midsection and a conical end section defining a hollow path through the opening cone, wherein the cylindrical midsection comprises a cage comprising a first profile having a first set of ribs and a second profile having a second set of ribs disposed downhole of the first profile, and a ball suspended in the cage between the first profile and the second profile, via the second set of ribs, wherein the second set of ribs is pressure rated to rupture at a predetermined pressure and release the ball into the conical end section, wherein the cage is configured to allow flow through the hollow path via the first set of ribs and the second set of ribs around the ball while the second set of ribs is not ruptured, and wherein the ball is configured to plug the hollow path of the opening cone when released into the conical end section.

14. The system of claim 13, further comprises:

a bottom displacement plug configured to travel through the tubular pipe towards the landing collar.

15. The system of claim 14, wherein the bottom displacement plug is configured to displace the pumped cement.

16. The system of claim 13, further comprises:

mud pumped into the tubular pipe through the mechanical stage collar and hollow opening cone configured to displace the bottom plug.

17. The system of claim 16, wherein the second stage cementing operation is performed through an open port.

18. The system of claim 13, further comprises:

a second stage cementing operation performed after the hollow path is plugged.

19. The system of claim 13, wherein the conical end section comprises an inner diameter equivalent to an outer diameter of the ball.

20. The system of claim 13, wherein the cage comprises a ball seat configured to hold the ball in place.

* * * * *